United States Patent [19]

Perales

[11] 4,291,803

[45] Sep. 29, 1981

[54] PROTECTIVE END CAP

[75] Inventor: Raul Perales, Exton, Pa.

[73] Assignee: Windsor Communications Group, Inc., West Chester, Pa.

[21] Appl. No.: 190,087

[22] Filed: Sep. 23, 1980

[51] Int. Cl.[3] ..... B65D 85/20

[52] U.S. Cl. ..... 206/443; 206/446; 206/303; 206/387; 206/391; 206/482; 220/23.4; 220/23.83; 220/225; 229/5.5

[58] Field of Search ..... 206/443, 446, 477, 480, 206/482, 483, 387, 303, 391; 220/253, 255, 23.4, 23.83; 229/5.5, 5.8

[56] References Cited

U.S. PATENT DOCUMENTS

| | | | |
|---|---|---|---|
| 1,156,074 | 10/1915 | Hahn | 206/482 |
| 1,643,421 | 9/1927 | Rowan | 206/482 |
| 2,883,045 | 4/1959 | Abramson | 229/5.5 |
| 3,098,721 | 7/1963 | Jewell | 220/255 |
| 3,115,376 | 12/1963 | Cupo | 206/391 |
| 3,349,986 | 10/1967 | Chapman et al. | 229/5.5 |
| 3,931,889 | 1/1976 | Roccaforte | 206/387 |
| 4,033,455 | 7/1977 | Robison | 206/391 |

*Primary Examiner*—Joseph Man-Fu Moy
*Attorney, Agent, or Firm*—Howard C. Miskin

[57] ABSTRACT

A package assembly includes a plurality of side-by-side similar open ended tubular articles, the openings at each end being closed by a common end member formed of a unitary blank. Each end member includes tongues projecting into respective articles, each tongue including superimposed similar panels joined at their outer edges along a fold line and having outwardly converging outer side edges and parallel inner side edges transversely spaced from the inner side edges of adjacent tongue panels. Coplanar wing panels project oppositely from the inner edges of corresponding sets of side-by-side tongue panels. In assembled condition the tongues retain the tubular articles in side-by-side positions and the wings close the receptacle end openings to facilitate the wrapping and display of the articles.

9 Claims, 4 Drawing Figures

PROTECTIVE END CAP

BACKGROUND OF THE INVENTION

The present invention relates generally to improvements in display and packaging devices and the like and it relates more particularly to an improved packaging assembly for storing, dispensing and handling elongated articles such as rolls of wrapping or decorative paper and similar articles.

In the handling, storing, shipping and dispensing of elongated tubular articles such as rolls of decorative wrapping paper it is a common practice to position the paper rolls in parallel side-by-side coextensive relationship and bind them into a single package to facilitate their handling. The devices heretofore employed for closing and assembling the tubular articles possess many drawbacks and disadvantages. They are awkward and expensive devices which are often difficult to apply and use, are of litte versatility and adaptability and otherwise leave much to be desired.

SUMMARY OF THE INVENTION

It is a principal object of the present invention to provide an improved multiple article packaging device.

Another object of the present invention is to provide an improved closure and retaining device for a plurality of elongated objects such as rolls of decorative wrapping paper and the like.

Still another object of the present invention is to provide an improved packaging or display device in which a plurality of elongated tubular articles are closed at their ends and maintained in a predetermined assembled condition such as in side-by-side arrangement by tube end closure members.

A further object of the present invention is to provide an improved device of the above nature characterized by its simplicity, low cost, attractive appearance, ease of application and use and great versatility and adaptability.

A device in accordance with the present invention includes a plurality of individual transversely spaced longitudinally extending parallel elongated tubular articles open at their opposite ends and having their opposite ends closed by common closure members which releasably engage the open ends of the tubular articles and releasably retain the tubular articles in a predetermined arrangement. Each of the closure members is formed of a unitary blank and includes article engaging tongues medially projecting from laterally oppositely projecting wing panels which overlay the tubular article openings in the assembled condition of the tubular articles and function as closure members. Each of the tongues is formed of a pair of superimposed panels joined at their outer edges along a fold line and having parallel inner side edges and outwardly conveying outer side edges. Each wing panel is joined along a fold or score line with the outer edges of side-by-side tongue panels, the adjacent inner side edges of succesive tongue panels being spaced a distance twice the thickness of the tubular article wall and sandwiching adjacent article walls between corresponding adjacent edges of successive tongues.

The improved package assembly employing the end closure members of the nature described above is highly attractive, reliable easy to use, of low cost and high versatility and adaptability.

DESCRIPTION OF THE PREFERRED EMBODIMENT

Figure 1:
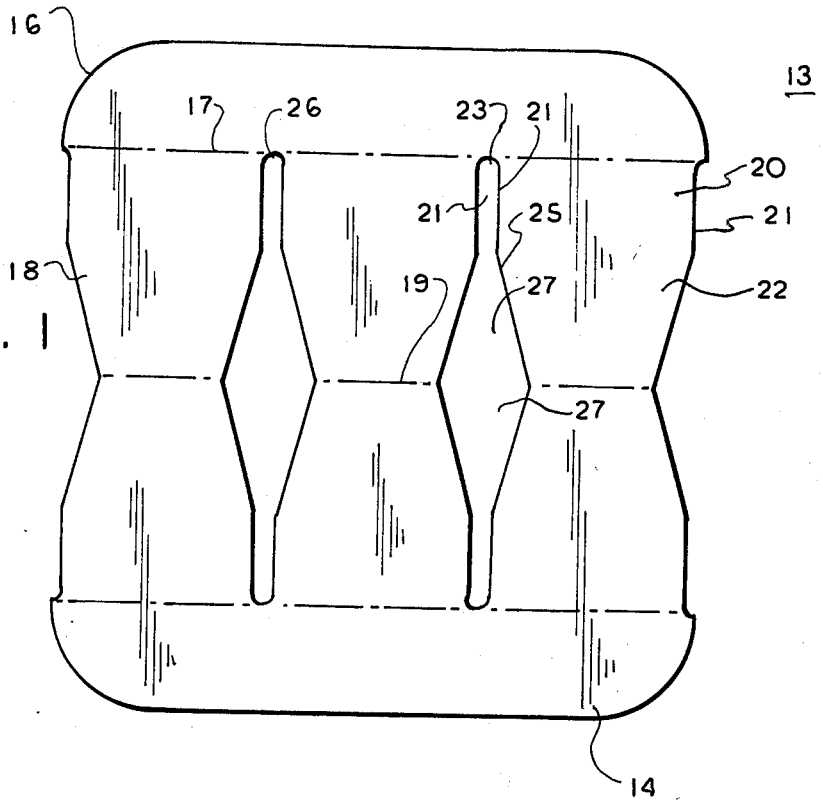
FIG. 1 is a plan view of a lay flat cut blank employed in producing an end closure member in accordance with a preferred embodiment of the present invention.
Figure 2:
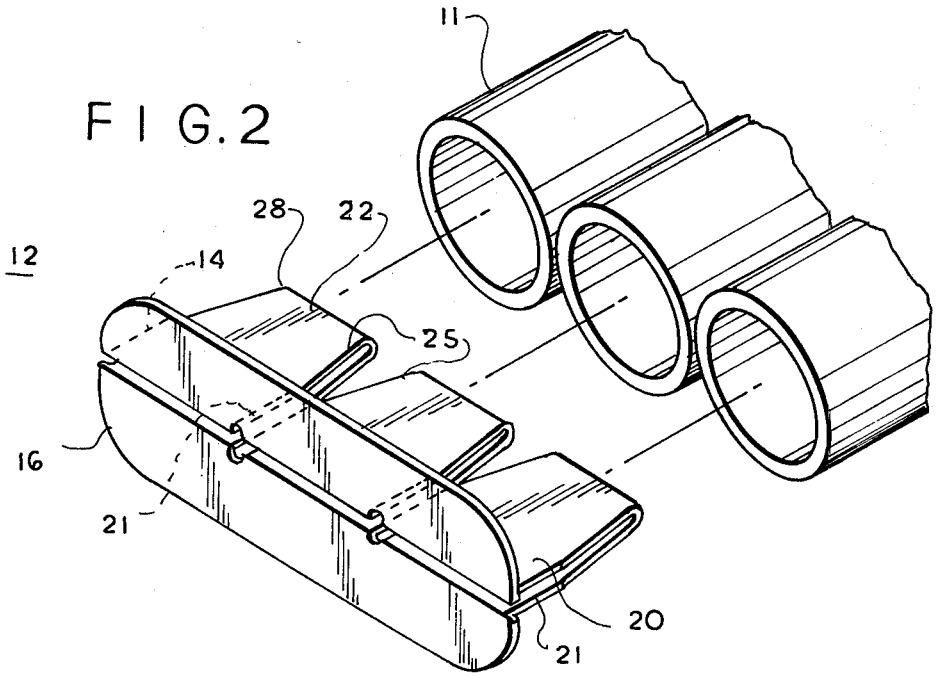
FIG. 2 is a perspective view of the completed closure member illustrating its position attendant to its assembly with a group of tubular articles.
Figure 3:
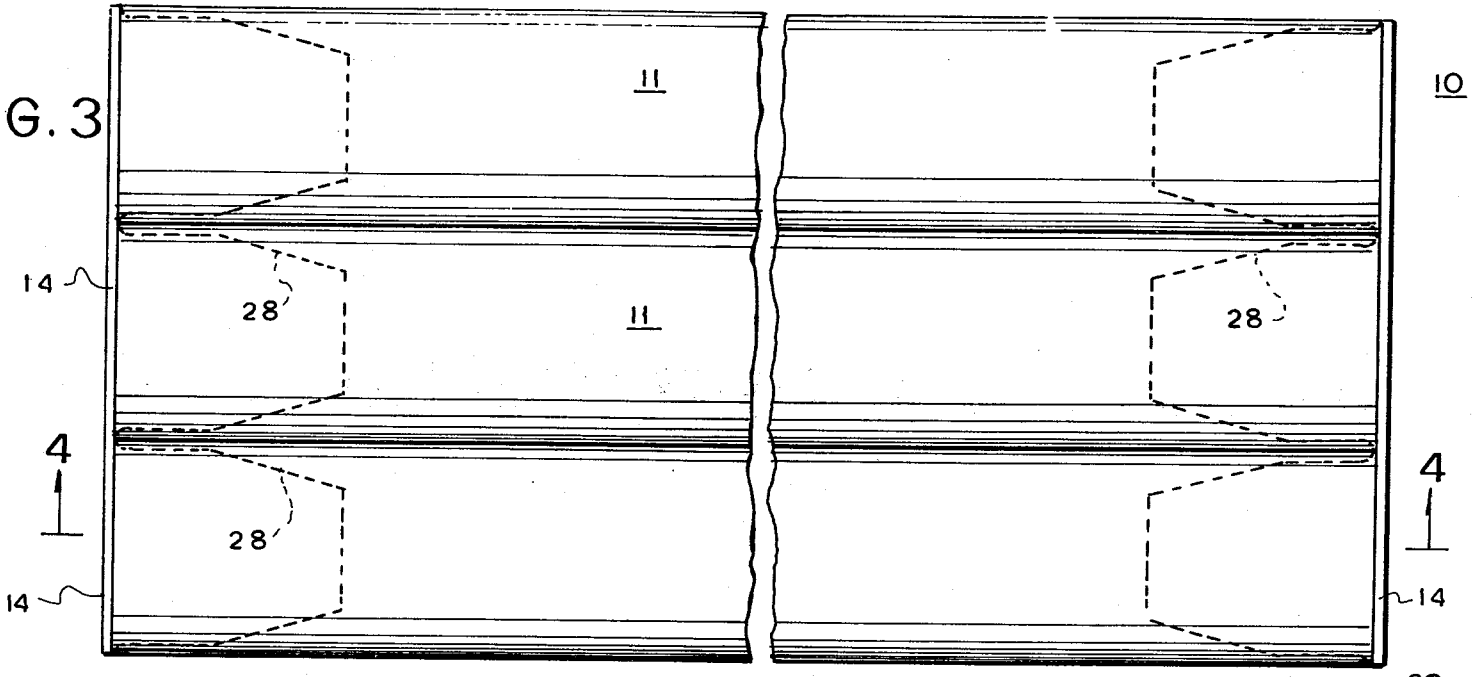
FIG. 3 is a front elevational view of a package assembly embodying the present invention and employing the present invention and employing the end closure member shown in FIGS. 1 and 2.
Figure 4:
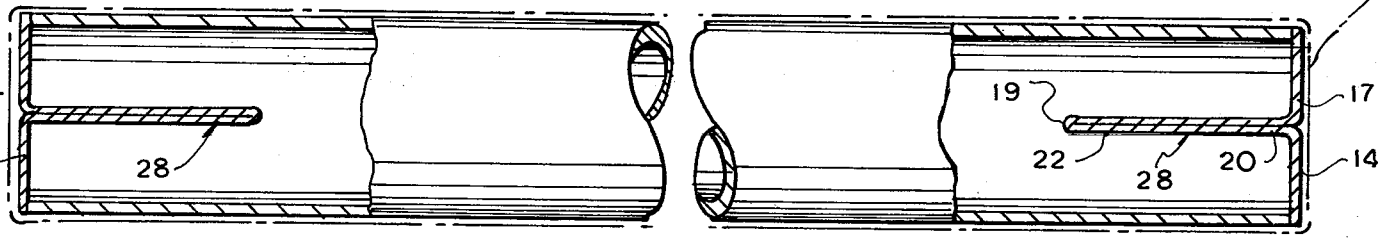
FIG. 4 is a sectional view taken along line 4—4 in FIG. 3.

Referring now to the drawings which illustrate a preferred embodiment of the present invention, the reference numeral 10 generally designates the improved package assembly which includes a plurality of coextensive, parallel, side-by-side substantially coextensive elongated cylindrical tubular articles 11 open at their opposite ends and separably engaged at their opposite ends by similar closure, retainer end members 12 which releasably engage and close the open ends of articles 11.

The structure of the present invention is advantageously applied to the packaging and display of rolls of decorative wrapping paper in which webs of paper are self wound into cylindrical tubes or are wound on tubular cylindrical cores formed of cardboard or the like, the paper rolls corresponding to tubular articles 11. While in the illustrated embodiment a group of three laterally spaced side-by-side articles are shown in the assembly 10 more or less than three may be packaged as may be more than one group of side-by-side articles which are likewise substantially coextensive and in which the groups are arranged transversely spaced and advantageously in front to back contact and the end members 12 correspondingly modified so that a single end member engages all of the corresponding ends of the articles 11.

Each of the end member 12 is formed of a unitary blank 13 cut and stamped from flat stock and as thin relatively stiff cardboard of desired quality or other suitable material. The blank 13 includes a pair of opposite similarly shaped transversely extending parallel cover defining outer panels 14 of elongated rectangular configuration rounded at their outer corners 16. Connecting the inner parallel edges 17 of panels 14 which edges 17 are defined by fold or score lines are laterally spaced similar tongue defining pairs of similar panels 18 which are joined along their inner edges by medial transverse fold or score lines 19.

Each of the panels 18 includes an outer rectangular section 20 having parallel transverse opposite side edges 21 and a trapezoidal inner section 22 extending from the inner edge of outer panel section 20 and having symmetrical converging side edges 25 joining the ends of a respective fold line 19. The adjacent edges 21 of successive outer panel sections 20 are transversely parallel and separated by a slot 23 of a width approximately equal to twice the wall thickness of an article 11 and having a rounded outer end 26 at about fold line. The adjacent oblique edges 25 of successive tongue panel sections 22 symmetrically diverge to fold line 19 to delineate a trapezoidal opening 27, at its narrow outer end joining a respective slot 23 and its inner end a corresponding opposite opening 27. It should be noted that oblique edge 25 may be shorter or longer than shown and may be curved instead of linear as illustrated.

In forming an end member 12 from a blank 13 the blank 13 is folded along medial line 19 to bring panels 18 of pairs of transversely opposite panels 18 into confronting positions in which the panels 18 are advantageously parallel and may be superimposed and form retainer tongues 28. The panels 14 are folded relatively outwardly along score line 17 to coplanar positions substantially perpendicular to the plane of tongues 28 and define closure wings.

The package 10 is simply assembled merely by inserting a tongue 28 of an end member 12 into each adjacent opening of a group of side-by-side tubular articles 11 and advancing the end member 12 until the wing members engage and close the adjacent open ends of articles 11. Another end member 12 is similarly applied to the opposite end openings of articles 11. The contacting walls of adjacent articles 11 engage corresponding pairs of slots 23, and are snuggly sandwiched between opposing pairs of edges 21 to releasably retain the articles 11 and end members 12 in a firm assembled condition. In this position the articles 11 may be conveniently and attractively displayed and may be expeditously packaged in an outer wrapper 30 which may be transparent to provide visual access to articles 11. The width of wing panels 14 are each advantageously about equal to half the width of an article 11.

While there has been described and illustrated a preferred embodiment of the present invention, it is apparent that numerous alterations, omissions and additions may be made without departing from the spirit thereof.

I claim:

1. A package assembly including a plurality of transversely spaced longitudinally extending, parallel substantially coextensiveopen ended elongated tubular articles and an end member located at each end of and engaging said tubular articles and characterized in that at least one of said end members is formed of a unitary blank and comprises a plurality of transversal spaced longitudinally extending tongues projecting into respective articles and engaging the inside faces thereof and each including superimposed first and second panels integrally joined along a fold line at their outer edges and a pair of oppositely directed wing panels joined at their inner edges along fold lines to the inner edges of said first and second wing panels respectively, said wing panels engaging and substantially closing the corresponding ends of said articles.

2. The package assembly of claim 1 wherein said end members are of similar construction.

3. The package assembly of claim 2 wherein said tubular articles are of cylindrical configuration and are retained in side-by-side relationship by said end members.

4. The package assembly of claim 3 wherein the adjacent inner edges of successive tongue members are transversely spaced a distance substantially equal to twice the wall thickness of a tubular article and the walls of adjacent wall articles are sandwiched between said adjacent inner edges of respective tongue members.

5. The package assembly of claim 4 wherein the outer opposite edges of each of said tongue members outwardly converge.

6. The package assembly of claim 1 wherein said wing panels are substantially coplanar and perpendicular to said tongues.

7. The package assembly of claim 3 including an outer wrapper enclosing the assembled tubular articles and end members.

8. The package assembly of claim 7 wherein said outer wrapper is a transparent web.

9. The package assembly of claim 1 wherein said tubular articles are rolls of paper.

* * * * *